US008162275B2

(12) United States Patent
Reusser

(10) Patent No.: US 8,162,275 B2
(45) Date of Patent: Apr. 24, 2012

(54) GALLON PAINT CAN, PAINT BRUSH, AND SCRAPER/WIRE BRUSH HOLDER FOR D-RUNG STYLE EXTENSION LADDERS

(76) Inventor: Dennis Reusser, Olathe, KS (US)

( * ) Notice: Subject to any disclaimer, the term of this patent is extended or adjusted under 35 U.S.C. 154(b) by 0 days.

(21) Appl. No.: 12/780,827

(22) Filed: Jul. 19, 2010

(65) Prior Publication Data

US 2011/0057079 A1 Mar. 10, 2011

Related U.S. Application Data

(60) Provisional application No. 61/240,687, filed on Sep. 9, 2009.

(51) Int. Cl.
*E06C 7/14* (2006.01)
*A46B 17/02* (2006.01)

(52) U.S. Cl. ..... 248/210; 248/110

(58) Field of Classification Search ..... 248/210, 248/687, 211, 110, 205.1, 238; 182/129
See application file for complete search history.

(56) References Cited

U.S. PATENT DOCUMENTS 3,160,383 A * 12/1964 Lamm ..... 248/211
4,099,693 A 7/1978 Blann
4,523,733 A 6/1985 Lunden, Jr.
4,702,446 A * 10/1987 Brown ..... 248/210
4,824,060 A 4/1989 Korda
5,316,251 A 5/1994 McGraw
5,649,682 A 7/1997 Martin
5,845,742 A 12/1998 Tade
5,934,632 A 8/1999 Weaver
5,960,905 A * 10/1999 Gardner ..... 182/129
6,076,636 A * 6/2000 Tietge ..... 182/129
6,352,135 B1 * 3/2002 Jones ..... 182/129
6,766,990 B1 * 7/2004 Hileman et al. ..... 248/210
6,824,115 B1 * 11/2004 Batson ..... 248/238
7,905,458 B2 * 3/2011 Hohensee ..... 248/210

* cited by examiner

*Primary Examiner* — Anita M King

(74) *Attorney, Agent, or Firm* — Stinson Morrison Hecker LLP

(57) ABSTRACT

A gallon paint can, brush, and scraper/wire brush holder for use with hollow D-rung ladders. The device includes an annular support member defining a recess into which a can, typically a standard one gallon paint can, or other container can be placed. The can, brush and scraper/wire brush are secured and prevented from falling through the recess of the ladder rung. Attached to the device is a rung insert member, comprising a smooth or ribbed tube with Neoprene washer inserts which can be inserted through the hollow rung in a snug fit, allowing the can to self-level by operation of gravity.

5 Claims, 6 Drawing Sheets

GALLON PAINT CAN, PAINT BRUSH, AND SCRAPER/WIRE BRUSH HOLDER FOR D-RUNG STYLE EXTENSION LADDERS

CROSS-REFERENCE TO RELATED APPLICATIONS

This application is based on and claims priority to U.S. Provisional Application Ser. No. 61/240/687, filed on Sep. 9, 2009, which is incorporated herein by reference.

FIELD OF THE INVENTION

This invention relates to securely attaching a paint bucket to a hollow rung extension ladder so that the contents are conveniently available to a user and so that the paint bucket can be easily removed and relocated without adversely impacting the user's activities. The primary use of the invention will be to hold a can of paint while the ladder is being used by a painter, but the invention may also be used as a holder for tools or other items.

BACKGROUND OF THE INVENTION

Many past patents related to Extension Ladders have attempted to address the "Paint and Accessory" issue. All or most provided a "Single solution" and/or were bulky and difficult to set up and use. After the ANSI standards were adopted and D-Rungs became the standard in the 80's and 90"s, ladders became much safer platforms. Building on this history the above product(s) bring together the ease of use and multi-functionality homeowner and professional users need while increasing safety and productivity.

Several examples of holders for hollow-rung ladders can be cited. For example, U.S. Pat. No. 4,523,733 by Lunden, Jr. discloses a rigid tube with a suspended shelf on one of its ends. When the opposite end of the tube is inserted into the hollow rung of a ladder, the rigid tube is thereby supported, which in turns supports the suspended shelf on which a paint can is placed.

U.S. Pat. No. 4,702,446 by Brown describes a "ladder caddy" which again uses a rigid tubing member to be inserted into a hollow ladder rung. Rather than a shelf surface, however, Brown discloses a snap-lock holding band. The paint can is placed within the band, which is then snapped closed, tightening around the can. The band itself is attached to the rigid tube through various wooden parts, such that the band, and paint can held therein, hang below the rigid tube which has been inserted into the hollow ladder rung.

Yet another invention along these lines is U.S. Pat. No. 4,824,060 to Korda. This invention discloses a rod which is long enough to extend completely through a hollow ladder rung. One end of the rod is threaded, thereby allowing a paint can holder to be secured by a wing nut to the rod. The opposing end of the rod has a pivoting latch plate which by gravity drops down to a vertical position once the rod has been inserted completely through the hollow ladder rung, thus supposedly securing the rod in place in the rung. The paint can holder portion of Korda's invention is simply a U-shaped frame with a cylindrical top piece conforming to the diameter of the paint can. The paint can rests on the U-shaped frame and is held in place by the cylindrical top piece.

Most of the patents researched were from a non-analogous art. Some involved a paint bucket holder that attached to the user's silhouette, others mounted on a step ladder, others either clamped to the edge of an extension ladder or were hung from a ladder rung. The eight patents listed herein were found to apply to the art of a paint bucket holder using a ladder hollow rung for attachment. All eight of these inventions have disadvantages that the present invention overcomes. There is a basic over-all security issue with all eight inventions, due generally to the approach to attachment of the paint can to the ladder hollow rung. The paint bucket has the capability to essentially swing or rotate about the horizontally disposed axis established by the support arm inserted in the hollow rung. This is generally done to maintain the paint bucket in a level, upright orientation. The disadvantage of this approach is that it creates a perception of insecurity on the part of the user due to movement of the paint bucket while paint is being extracted with a brush, especially as the level of the paint in the bucket decreases. The degree of risk of this movement during usage is invention specific, dependent upon the support arm cross section design.

Inventor Issue Date U.S. Pat. No. 5,934,632 Norman W. Weaver Aug. 10, 1999 U.S. Pat. No. 5,845,742 Erin Jessica & Robert Thomas Tade Dec. 8, 1998 U.S. Pat. No. 5,649,682 Julius F. Martin Jul. 22, 1997 U.S. Pat. No. 5,316,251 Raymond V. McGraw May 31, 1994 U.S. Pat. No. 4,824,060 Edward S. Korda Apr. 25, 1989 U.S. Pat. No. 4,702,446 Franklin C. Brown Oct. 27, 1987 U.S. Pat. No. 4,523,733 Charles K. Lunder, Jr. Jun. 18, 1985 U.S. Pat. No. 4,099,693 Ellis L. Blann Jul. 11, 1978

U.S. Pat. No. 5,934,632 by Weaver describes a utility can holder for use with hollow rung ladders. The paint can or bucket rests with the bail connecting knobs, or alternately, the bucket lip, contacting the upper surface of an annular support member. This support member is rigidly attached to a rung insert member which extends completely through the ladder hollow rung from one side to the other. Flexible tabs are compressed prior to insertion of this member into the rung and then open on the other side of the ladder to prevent inadvertent extraction from within the rung. The annular support member is rotatable within the rung to allow leveling of the paint bucket. This rotatability may cause instability as the user extracts paint from the bucket, as discussed in the preceding paragraph. It is also evident that the positioning and attachment of the paint bucket on the ladder is a two step procedure. The rung insert member must be secured within the selected ladder hollow rung prior to inserting the paint bucket into the container recess. The insertion of the rung insert member into the hollow rung is a "two hand operation", involving holding the approximately 30 inch long holder with one hand and depressing the flexible tabs with the other hand. Only after the rung insert member is in place can the user climb off the ladder and transport the paint bucket back up the ladder to insert it into the container recess. Thus, significant complication is involved with moving the paint can holder from position to position on the ladder.

U.S. Pat. No. 5,845,742 by Tade describes a paint can or bucket hanging by its bail from a T-shaped support member which is attached to one end of an extension member. The rod-like extension member is inserted into a ladder hollow rung. The paint bucket is supported by its bail which is vertically disposed directly above the lip of the paint bucket. This positioning of the bail interferes with extraction of the paint from the bucket with a paint brush.

U.S. Pat. No. 5,649,682 by Martin supports a container within an encircling cincture formed from a flattened projecting arm that is inserted into a ladder hollow rung. The support part of the projection arm that is inserted into the ladder hollow rung is relatively short and is not attached securely within the hollow rung. There is, at least, the perception of this device being a security risk due to the real possibility that the arm may be inadvertently extracted from the rung opening during usage.

U.S. Pat. No. 5,316,251 by McGraw is directed at leveling a paint can in two dimensions. The paint can rests upon a wrap around frame that is elliptical shaped and may be either closed or open at one end. This frame is rigidly attached to a cylindrical handle that is inserted into a ladder hollow rung to support the frame and the paint can. The disadvantage of this approach is that the paint bucket may be dislodged from its position atop the frame and, at least, spill some or all of its contents, or at worst, be a safety hazard to persons on the ground. As with the invention by Martin, the cylindrical handle is relatively short compared to the length of the ladder rung and is not secured within the ladder rung. In addition, in one embodiment of the invention, the paint can is not enclosed on one side by the wrap-around frame, increasing the risk of dislodgment. Both of these conditions contribute to the perception of insecurity by the user.

U.S. Pat. No. 4,824,060 by Korda provides a holder for supporting a paint bucket or can that is basically a cradle in which the paint can rests on a plate and is contained within a cylindrical member slightly larger in diameter than the outside of the paint can. A detachable rod is inserted through the ladder rung such that a swing plate latch falls vertically and secures the rod from extraction from the rung. The "cradle", containing the paint bucket is attached to the other end of the rod. Korda's approach provides a higher degree of security than is available for the inventions previously discussed. However, the procedure for mounting the paint bucket onto the ladder is fairly complicated, not providing for ease of movement to another rung on the ladder by the user. The rod is mounted at the desired position on the ladder before the holder is attached to the end of the rod, followed by insertion of the paint bucket into the holder cradle. This procedure appears to involve at least two, and maybe more, trips up the ladder, and is not compatible with easily and conveniently changing the position of the paint can while the user is working on the ladder.

As the above indicates, there has been a good deal of effort in this area, but at least from applicant's perspective, little notable success commercially or in the field. This can be attributable to disadvantages inherent in the prior art, including over-complexity and inconvenience to use. Applicant also believes there may be a problem with perception, with painters being resistant to using any device which does not give the clear appearance of being able to securely hold a can of paint without the danger that the holder can come loose, spilling the contents of the paint can below, with potentially disastrous results.

SUMMARY OF THE INVENTION

Unique one-gallon paint can support for "D-Rung" type Extension Ladders also providing two paint brush hooks & wire brush or scraper holder in plastic, two-piece unit. The mounting shaft inserts into any level of outwardly facing D-shaped opening or "D-Rung" of the ladder. D-Shaped mount engages the inner wall of any rung providing full support for the tool. Paint can is supported by metal loop handle on can and held steady by custom loop mount. Brushes are hung on either of two hooks on both sides of main body. Special opening through mid-section of main body supports wire brush or paint scraper Unique one-gallon paint can support for "D-Rung" type Extension Ladders also providing two paint brush hooks & wire brush or scraper holder in plastic, two-piece unit.

It is thus an object of the invention to provide a gallon paint can, paint brush, and scraper holder for D-Rung style extension ladders.

It is a further object of the invention to provide an easily removable paint can, brush and scraper to a hollow D-rung ladder.

DETAILED DESCRIPTION OF DRAWINGS

Figure 1:
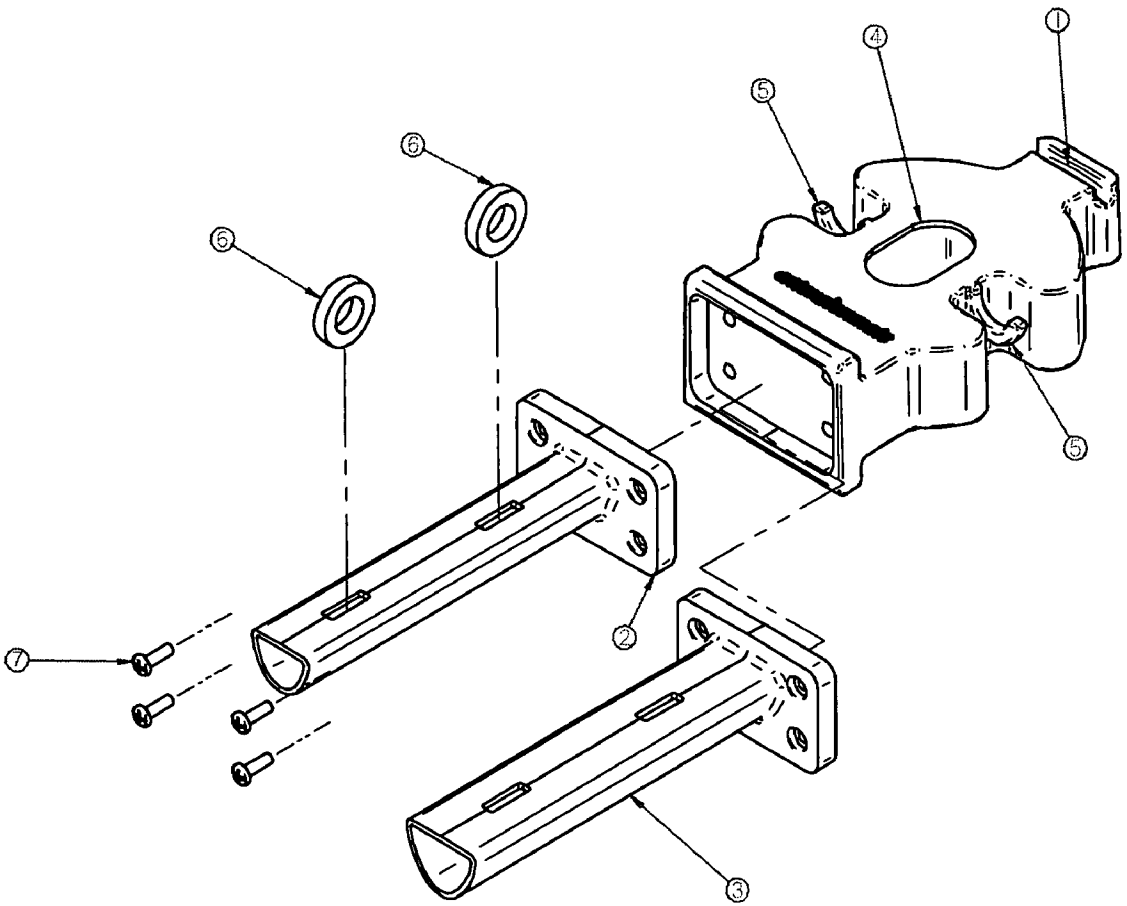
FIG. 1 Exploded View of Gallon Paint Can Holder with both D-Rung Extrusion Mounts FIG. 2A Bottom View of Gallon Paint Can Holder Assembled FIG. 2B Side View of Gallon Paint Can Holder Assembled FIG. 2C Top View of Gallon Paint Can Holder Assembled FIG. 2D Back view of Gallon Paint Can Holder Assembled FIG. 2E Isometric View of Gallon Paint Can Holder Assembled FIG. 3 Gallon Paint Can Holder Only FIG. 4 Large D-Rung Extrusion Mount FIG. 5 Small D-Rung Extrusion Mount FIG. 6 Ladder View with Paint Can Holder Installed

FIG. 1: Paint Can Holder (1) incorporates two Paint Brush Hooks (5) that allow the use of two different size brushes. Paint Can Holder (1) also incorporates Paint Scraper/Wire Brush Holder (4) making these readily available to user while on ladder. Paint Can Holder (1) utilizes a single mounting system using either Large D-Rung Extrusion Mount (3) or Small D-Rung Extrusion Mount (2) depending on weight and height limits of said ladder. D-Rung mounts use four 10-32 mm screws (7) to secure to Paint Can Holder (1) and two Neoprene Washer Inserts (6) which add "Non Slip" to the D-Rung Extrusion Mounts (2,3) to the inner wall of any D-Rung on ladder.

Figures 2A, 2B, 2C, 2D, 2E:
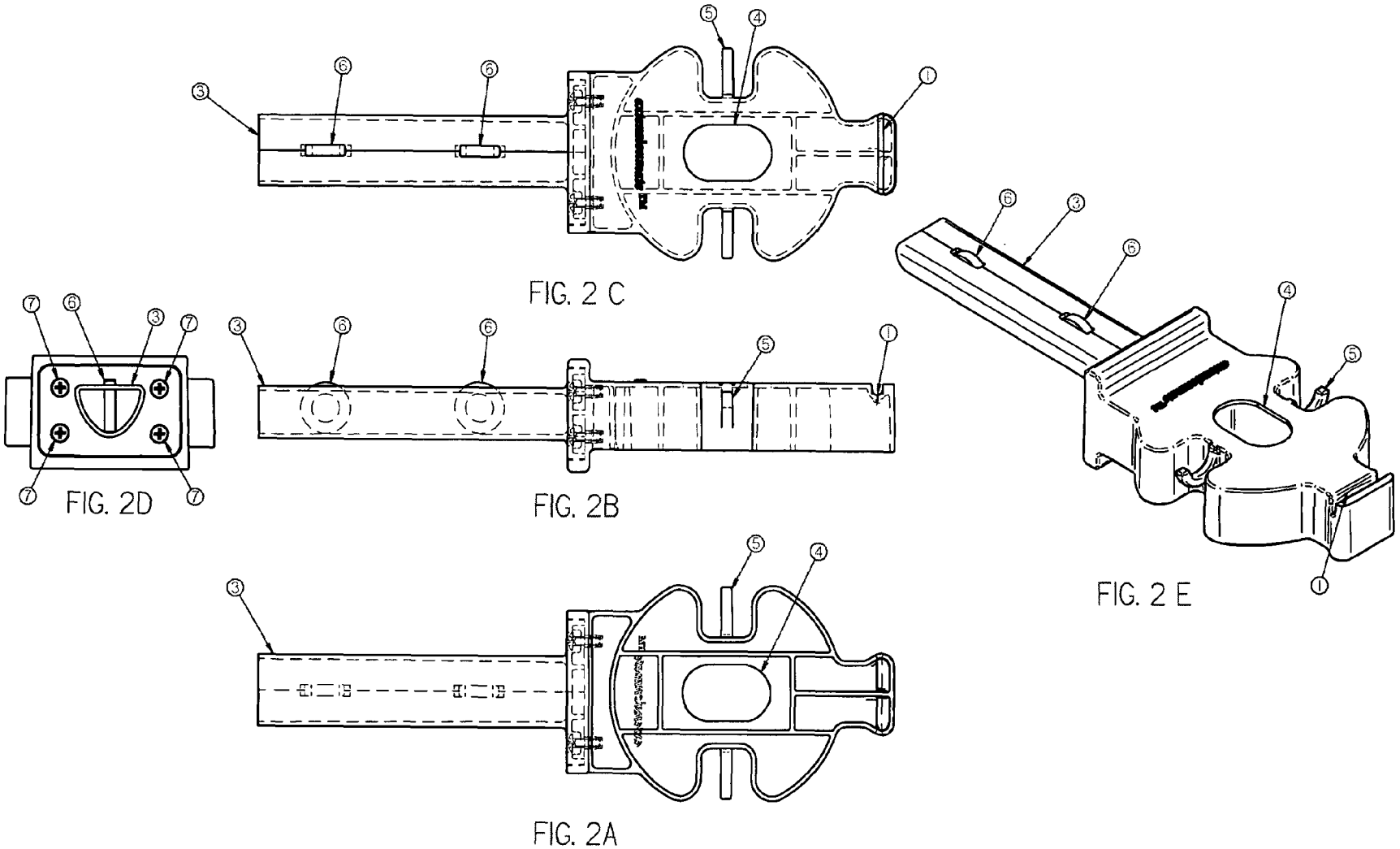

FIG. 2A: (Bottom View) Shows D-Rung Mount (3), Paint Brush Hooks (5) and Paint Scraper/Wire Brush Holder (4).

FIG. 2B: (Side View) Shows Paint Can Mount (1), Brush Hooks (5), Neoprene Washer Inserts (6) and D-Rung Mount (3).

FIG. 2C: (Top View) Shows Paint Can Mount (1), D-Rung Mount (3), Paint Scraper/Wire Brush Holder (4), Paint Brush Hooks (5), and Neoprene Washer Inserts (6).

FIG. 2D: (Back View) Shows D-Rung Mount (3), Neoprene Washer Inserts (6), and 10-32 mm Stainless Steel Screws (7).

FIG. 2E: Shows Paint Can Mount (1), D-Rung Mount (3), Paint Scraper/Wire Brush Holder (4), Paint Brush Hooks (5), and Neoprene Washer Inserts (6).

Figure 3:
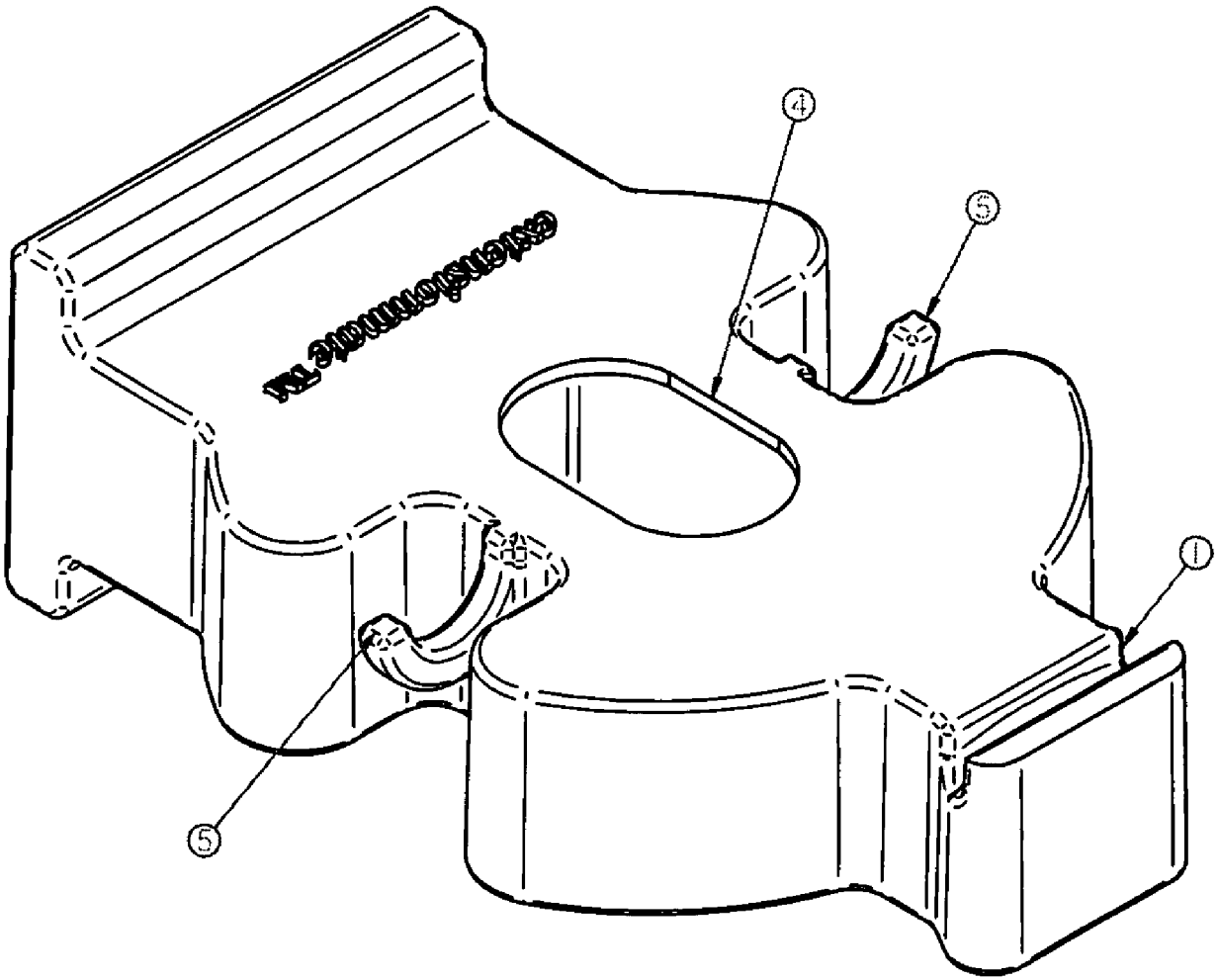

FIG. 3: Shows Paint Can Holder (1) Paint Brush Hooks (5) and Paint Scraper/Wire Brush Holder (4).

Figure 4:
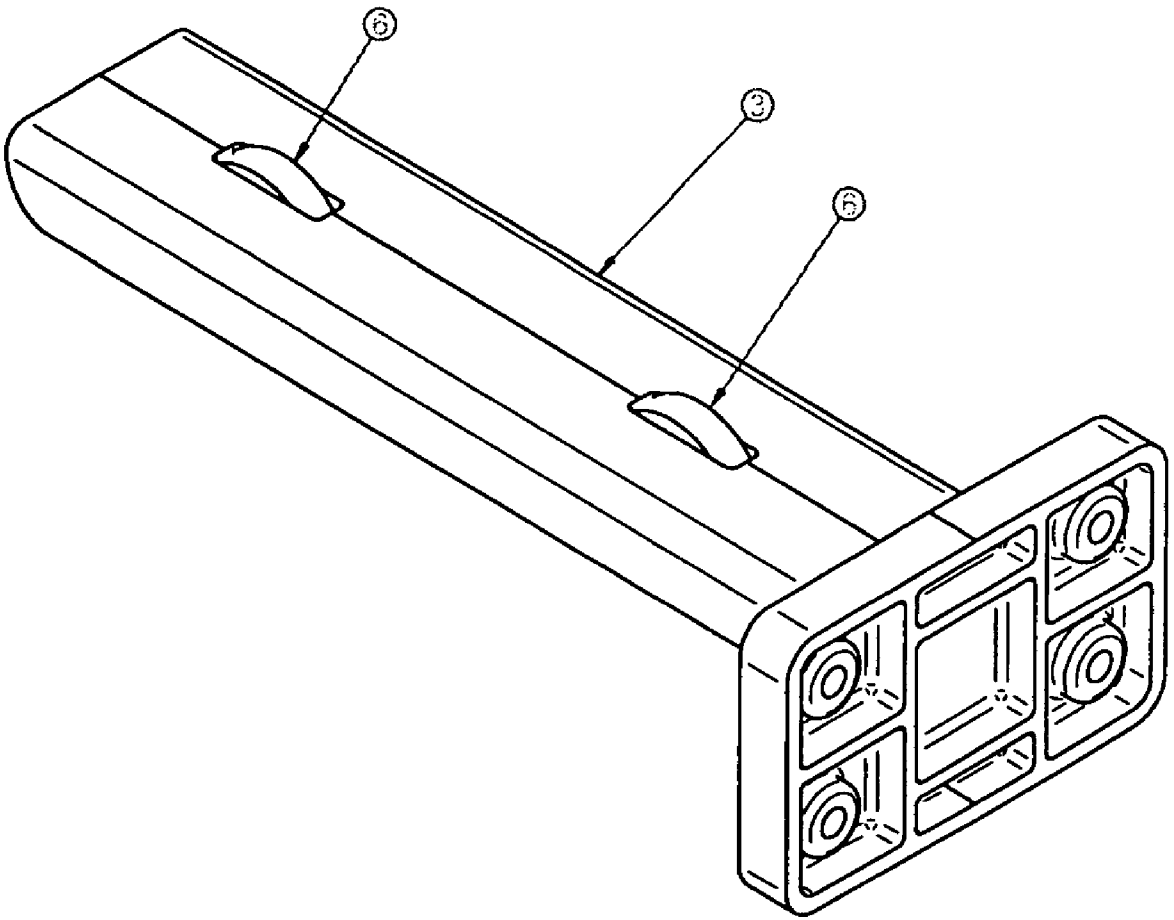

FIG. 4: Shows Large D-Rung Extrusion Mount (3) and Neoprene Washer Inserts (6).

Figure 5:
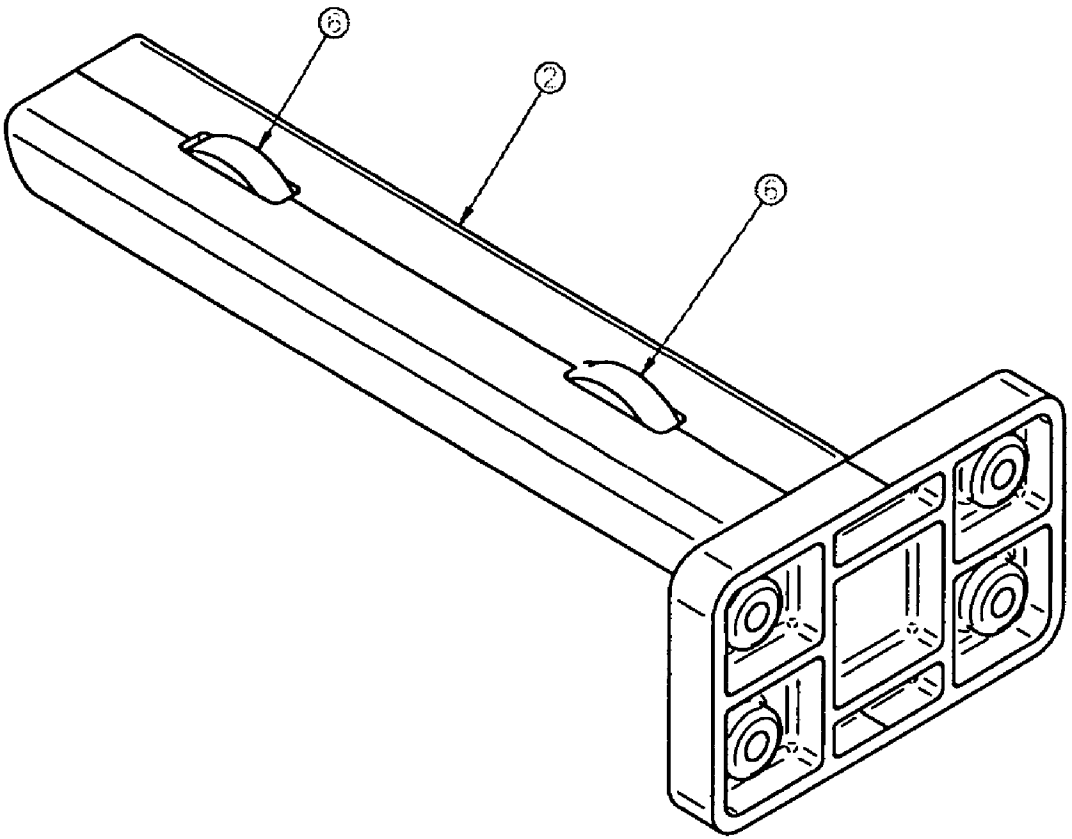

FIG. 5: Shows Small D-Rung Extrusion Mount (2) and Neoprene Washer Inserts (6).

Figure 6:
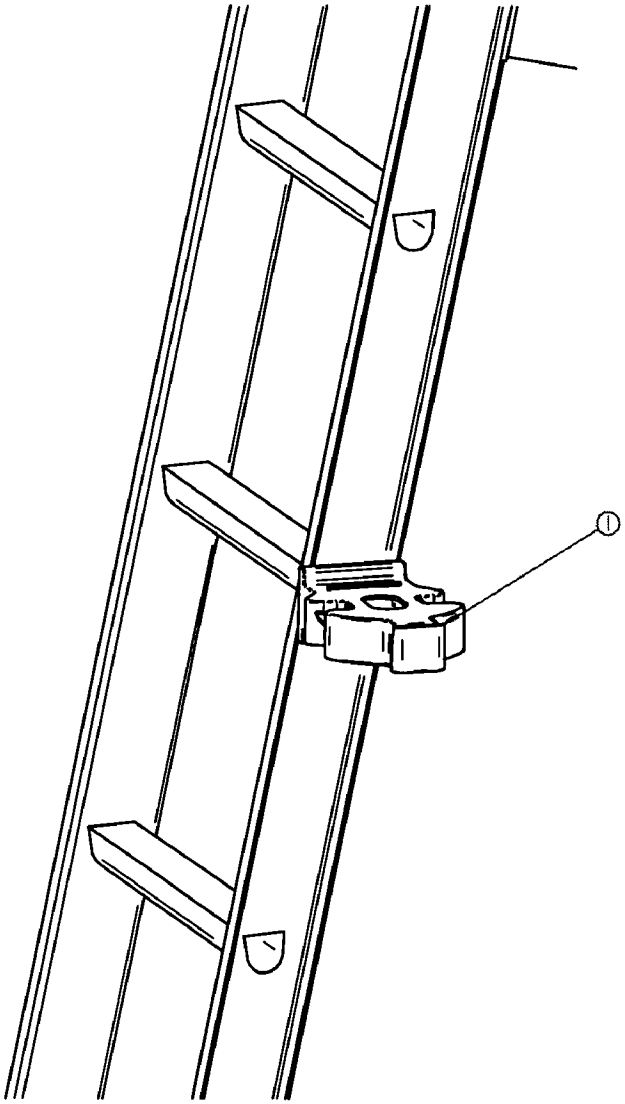

FIG. 6: Shows Paint Can Holder (1) installed in D-Rung of Extension Ladder and ready for use.

I claim:

1. A device for temporary attachment of paint accessories to the outer rungs of a ladder, comprising: one or more extension mounts to secure the device to a ladder via insertion of the extension mount into the interior of one or more ladder D-rung openings, the extension mount comprising a hollow D-shaped shaft having one or more openings for a washer insert along a flat surface of the shaft and a surface perpendicular to the D-shaped shaft wherein the extension mount attaches to the device; the device comprising a gallon paint can holder section having an outward facing hook and a base paint can support piece that attaches to the ladder via the extension mount; one or more paint brush holder hooks along opposite sides of the device designed to receive and hold a paint brush; and an opening through the center of the device designed to receive and hold a paint scraper/wire brush tool.

2. The device of claim 1, wherein the D-rung extension mount can be removed and reattached to the device via a fastener.

3. The device of claim 1, wherein the D-rung extension mount can be detached from the device and a different sized D-rung extension mount can be substituted to the device via a fastener.

4. The device of claim 1, wherein the device can be mounted on either end of the ladder's D-rung.

5. The device of claim 1, wherein the device is constructed of a resin based material.

* * * * *